United States Patent [19]

Fox, Jr.

[11] Patent Number: 4,968,265

[45] Date of Patent: Nov. 6, 1990

[54] FLUIDLY ACTUATED ELECTRICAL CONNECTOR

[75] Inventor: Roy W. Fox, Jr., Williston, Vt.

[73] Assignee: Middleburg Corporation, Canton, Conn.

[21] Appl. No.: 374,622

[22] Filed: Jun. 29, 1989

Related U.S. Application Data

[63] Continuation-in-part of Ser. No. 226,466, Aug. 1, 1988, abandoned.

[51] Int. Cl.[5] ..... H01R 4/64

[52] U.S. Cl. ..... 439/197; 439/260; 439/263; 439/289

[58] Field of Search ..... 439/42, 66, 190, 197, 439/259, 260, 262, 263, 265, 492, 495, 499, 377, 592, 593, 266, 198, 329, 493, 267, 632, 289; 174/35 GC, 35 MS; 29/857, 868, 869, 870

[56] References Cited

U.S. PATENT DOCUMENTS

| | | | |
|---|---|---|---|
| 2,956,258 | 10/1960 | Raddin | 439/197 |
| 2,978,666 | 4/1961 | McGregor | 439/197 |
| 3,076,166 | 1/1963 | Raddin | 439/197 |
| 3,090,026 | 5/1963 | Raddin | 439/197 |
| 3,569,905 | 3/1971 | Kehagioglou | 439/197 |
| 4,540,227 | 9/1985 | Faraci | 439/260 |

FOREIGN PATENT DOCUMENTS

| | | | |
|---|---|---|---|
| 2495390 | 6/1982 | France | 439/197 |
| 1598308 | 9/1981 | United Kingdom | 439/197 |

OTHER PUBLICATIONS

IBM Bulletin, vol. 13 No. 11, 4–1971, M. L. Brain, Pneumatic Contactor.

*Primary Examiner*—Neil Abrams
*Assistant Examiner*—Khiem Nguyen
*Attorney, Agent, or Firm*—Chilton, Alix & Van Kirk

[57] ABSTRACT

Apparatus and method for connecting two electrical conductors (102,104) by means of a fluid bladder (110) interacting between a backing member (106) and one of the conductors (104). The bladder forms a compliant membrane surface (108) that transmits fluid pressure nearly hydrostatically from one conductor (104), to the other (102) such that the intimate contact of the surfaces (116) between the conductors provides an improved electrical connection, especially for small scale multi-conductors.

21 Claims, 10 Drawing Sheets

FLUIDLY ACTUATED ELECTRICAL CONNECTOR

This is a continuation-in-part of co-pending application Ser. No. 07/226,466 filed on Aug. 1, 1988, now abandoned.

BACKGROUND OF THE INVENTION

This invention relates to electrical connectors, and particularly to the type used in computers and similar electronic equipment.

In a variety of electronic applications, electrical connections must be made between one or a group of components, such as a circuit board, with one or a group of different components, such as a power source, a data bus, or the like. Commonly, these connections are not made directly between the components, but rather an intermediate connector is interposed between the components, usually the electrical connection between the components and the connector has been accomplished by some form of mechanical spring force between exposed contacts.

Until recently, such spring loading of the contacts was reasonably cost effective and posed few problems. As the size and/or complexity of circuit components and their associated printed or etched circuit conductors shrink, however, the size of the contacts for interconnecting components has also decreased. As the contact width of the electrical conductors and the spaces between the conductors drop below about 0.025 inch and now approach the range of 0.002–0.005 inch, known spring biased connectors cannot be effectively used. The forces required to make a mechanical spring connection between micro chips or miniature circuit boards cannot be provided by the small cross section of the contacts. The result is that a single chip must be mounted in a lead frame or similar device to provide expanded circuit paths and spaces, then the expanded paths must be connected to still another circuit board to expand the spacing enough to communicate with other devices and peripherals.

Another problem encountered not only with small multi-conductors but in larger ones as well, is the difficulty of assuring that all individual contacts associated with a given connection, are properly engaged and in intimate contact for efficient electrical conduction. Known connectors typically rely on rigid mechanical interaction between the connector and the conductors. This results in a wide variation in the force available for engaging individual contacts on the conductors.

Even in connections between single strand conductors, only a portion of the available contacting surfaces are actually mated, the rigid mechanical connector typically producing a distribution of point or line contacts rather than the desired intimate mating of the full contact surfaces.

SUMMARY OF THE INVENTION

Accordingly, it is an object of the present invention to provide an electrical connector system and method for establishing and maintaining electrical contact between components, or other conductive members to be joined, which does not have an inherent minimum line and space limitation that is dependent upon the spring characteristics of the mating contact structures, whether they be beams or sockets.

It is another object of the invention to provide apparatus and method for accomplishing an intimate electrical connection between single conductors or multi-conductors, for both interference fit and zero force fit connectors.

It is a further object of the invention to provide a socket connector suitable for connecting a plurality of conductors substantially coaxially, for electrical and other signal transmission including optical transmission.

In accordance with the invention, compliant structures and fluid springs eliminate the need for mechanical spring beams.

In its broadest aspect, the invention comprises apparatus and method wherein first and second conductors are overlapped, and a backing member is spaced from the second conductor. A compliant membrane is positioned between the backing member and the second conductor. Means are provided for interacting with the backing to urge the membrane against the second conductor, whereby the second conductor establishes intimate electrical contact with the first conductor. Fluid pressure is preferably used to urge the membrane against the second conductor. The fluid membrane can take the form of a thin metal or plastic tube that is filled with fluid and sealed, or the fluid in the tube may be selectively pressurized by an associated actuation member.

In one embodiment of the invention, a guide is positioned to receive first and second electrically conducting members to be connected, the guide establishing alignment of the contacts on the members. Locking means are carried by the guide for selectively urging one member against the other member to lock the contacts into engagement. The locking means include a compliant membrane, preferably in the form of tubing that expands radially when the fluid therein is pressurized.

The guide into which the electrically conducting members are inserted for alignment and engagement can be a unitary structure fabricated in bulk and utilized at the time a connector bank is being assembled. The invention could also be embodied in a rack or other structure that is permanently formed on, for example, a computer chassis or on one or the other of the electrically conducting members to be connected, so long as such guide structure provides the functions in accordance with the invention as claimed.

In a more specific embodiment of the invention, a ribbon cable or other flat conductor is connected to the edge contacts on a circuit board by a guide that receives and cradles the cable and the board edge in overlapping relationship. The guide further includes a fluid-filled tube carried by a recess adjacent the overlapping cable and board. Once the cable and board are aligned within the guide member, the fluid is pressurized such that the tube expands and thereby contacts the cable, urging it against and locking it to the corresponding contact points on the circuit board. A plurality of such connections can be made side by side on a rack to form a connector bank or array.

In a particularly useful embodiment of the invention, the bladder is pressurized by a force balanced technique which compensates for tolerances, differential expansion and other effects due to temperature variations, as well as accumulated effects of wear and cycling. In this embodiment, means are provided for relatively positioning first and second conductors in substantially pressureless contact, with at least one conductor being supported by a rigid backing. "Substantially pressureless contact" as used herein includes mere "kissing" as well as a wiping between the conductors under light pressure. From this initial pressureless contact condition, a balanced force is applied to the other conductor by an increase in pressure of the fluid-filled bladder. The pressure increase in the bladder is transmitted to the other conductors such that an intimate, compliant connection therebetween is formed. The force balance is achieved by means of a spring structure or the like bearing against an exterior surface of the bladder remote from the direct or indirect contact between the bladder and one of the conductors.

The use of a spring as part of the actuating mechanism for increasing the pressure in the bladder, permits the use of a pivoting latch member for displacing a pressure plate or plug against the bladder, while producing an increase in bladder pressure that is substantially predetermined regardless of the displacement of the latch member. This embodiment is well suited for implementation in a chassis having a slot lined with a plurality of flex circuit contacts against which a card edge carrying a plurality of respective multi-conductors is inserted. In the preferred embodiment of this implementation of the invention, a gland member carries the bladder adjacent to and spanning the plurality of flex circuit contacts in the chassis. The multi-conductor edge is inserted into the slot of the chassis so that the respective multi-conductors are in alignment but not in contact. A guide member coupled to the gland is actuated by a cam latch mechanism such that during an initial portion of the movement of the latch, the gland flexes the chassis conductors into substantially pressureless wiping contact with the edge multi-conductors. As the latch mechanism is further displaced to its locked position, the bladder is pressurized to achieve the high pressure, compliant connection between the chassis and edge multi-conductors. Preferably, the latch edge includes a cam surface which drives pressure plugs against a spring surface which bears against the exterior surface of the bladder, thereby producing a predetermined pressure range increase that is substantially independent of the displacement of the cam surface.

In yet another embodiment of the invention, a plug and socket connector is provided for joining a plurality of signal conductors in the plug to a respective plurality of signal conductors in the socket. The socket body supports the socket conductors and includes means for receiving the plug conductors in mating relation with the socket conductors, means for coupling a socket body to the plug, and wall means defining a space associated with the means for receiving the plug conductors. An annular bladder is located in the space for surrounding each socket conductor, and is filled with a substantially incompressible fluid. The plug body supports the plug conductors and includes means interacting with the socket body for coupling the bodies together thereby defining a mated relationship between the socket and plug conductors. The mating relationship is improved in accordance with the invention, by means projecting from the plug body toward the annular space of the socket for bearing against the bladder. After the socket and plug bodies are coupled, a predetermined force is applied to the projecting means for pressuring the bladders and compliantly constricting the conductors to secure the conductors in aligned mating registry.

The fluidic actuation technique of the present invention, permits use of fine line circuit paths backed up by inflatable tubing, or other compliant surfaces. With the present invention the required insertion force when one member is placed into or overlapped with another member is essentially zero. The members are locked together after they have been aligned. When a connector bank is made up, each connection can be made independently and sequentially, if each connector carries its own fluidic actuator structure. Alternatively, all individual connectors in the connector bank could be actuated simultaneously through a common pressure source.

The invention may also be used advantageously where a force or interference insertion is still desired, but the resulting electrical connection between contacts is to be improved. In this embodiment, the fluid pressure on the membrane bearing against a conductor or contact, provides a fluid spring effect in substitution for the mechanical spring effect of prior techniques. The fluid spring provides a biasing force over a wider area of the contact, and therefore results in a more intimate electrical contact between the conductors.

BRIEF DESCRIPTION OF THE DRAWINGS

The preferred embodiments of the invention will be described below with reference to the accompanying drawings in which.

DESCRIPTION OF THE PREFERRED EMBODIMENT

Figure 7:
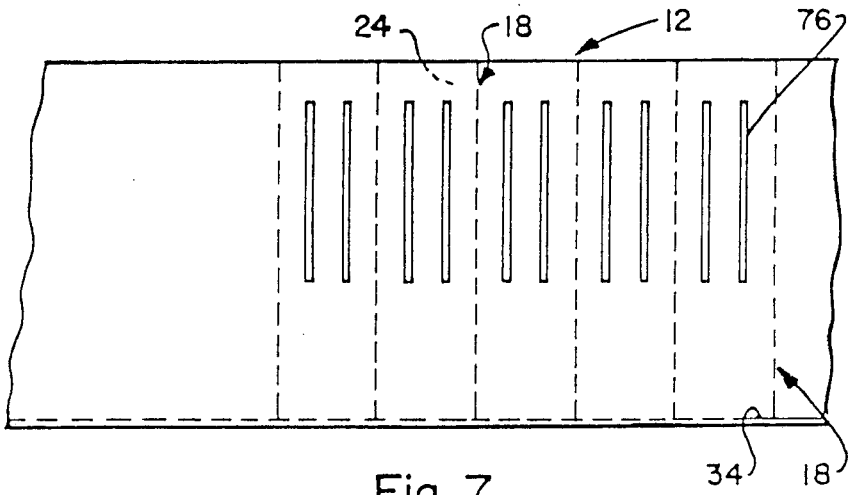
FIG. 7 is a schematic view of the rack wall through which the ribbon cable leads into the guide member as shown in FIG. 1.
Figure 8A:
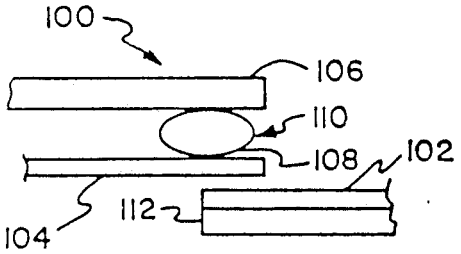
FIGS. 8(*a*) and (*b*) show a generic embodiment of the invention wherein a first conductor is connected to an adjacent second conductor by means of the transmission of hydrostatic pressure through a membrane, before and after actuation, respectively.
Figure 8B:
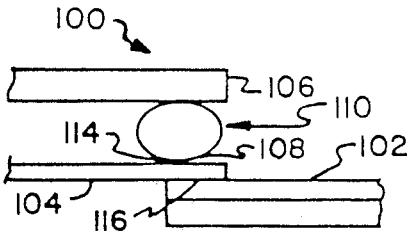
Figure 9:
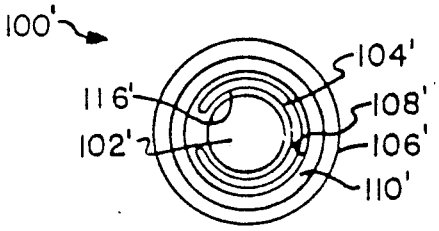
FIG. 9 illustrates another generic embodiment of the invention, wherein a pin and socket connection is accomplished by means of a toroidal fluid membrane.

The present invention will be described below in connection with specific types of hardware environments (FIGS. 1–7 and 10–12), and in broader embodiments that are not specific to any particular environment (FIGS. 8 and 9).

Figure 1:
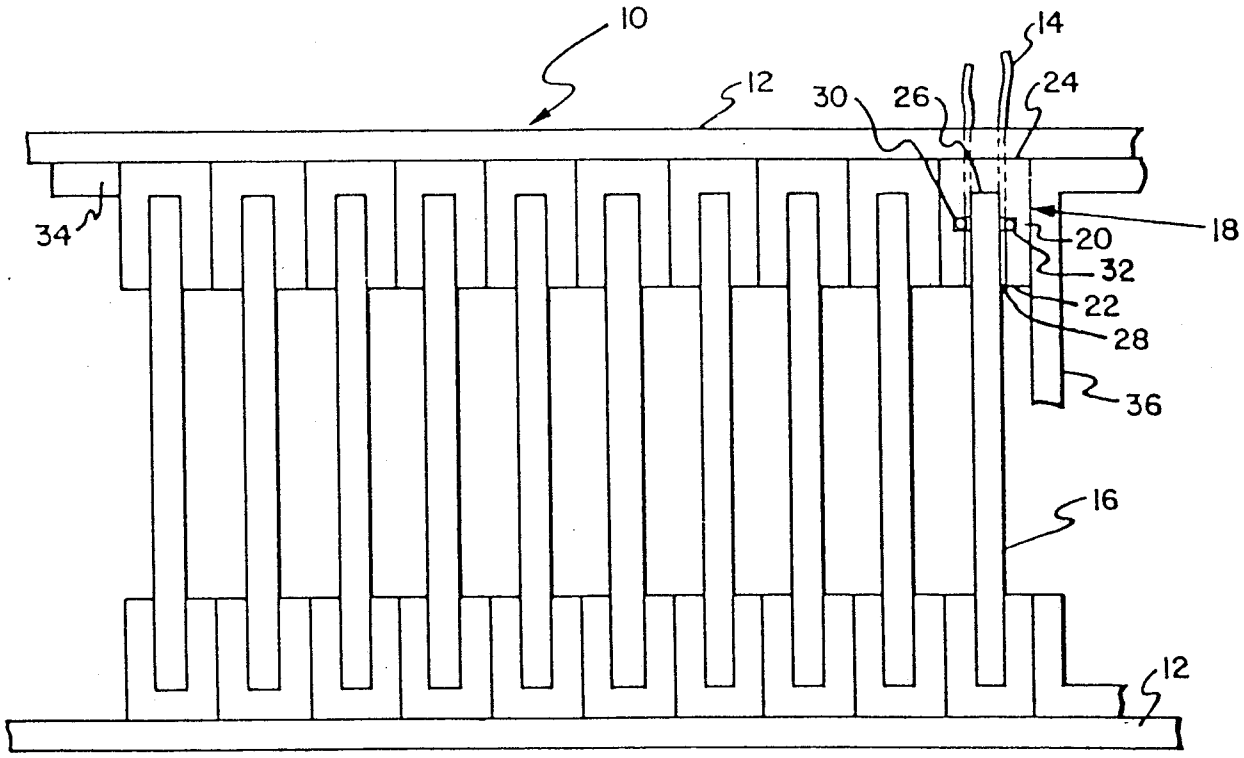
FIG. 1 is a schematic plan view of a bank of circuit boards having edge connectors in accordance with the present invention, to provide electrical connections between a plurality of ribbon cables and a plurality of circuit boards, in a closely packed array supported by a rack.

FIG. 1 shows a bank 10 of electrical connectors closely arranged in a rack structure 12, of the type that may be found in small scale electronic applications, such as microcomputer or similar hardware that requires the electrical connection of microchips and the like. The individual contacts of a first conductor member 14, typically a ribbon cable or the like, are to be electrically connected to respective contacts or terminals on a second conductor member 16, typically a circuit board.

In accordance with the invention, a connector 18 is in the form of a guide means 20 having an inner portion 22 facing the circuit board 16, and an outer portion 24 facing the source of the cable 14. As described more fully below, the leading end 28 of the cable 14 is brought through the outer portion 24 of the guide means and aligned with the contacts (not shown) on the circuit board. Locking means 30 are then actuated to generate hydrostatic-like lateral forces that conform the contacts on the cable 14 against the corresponding contacts on the board 16, thereby completing the required electrical connection.

Figure 2A:
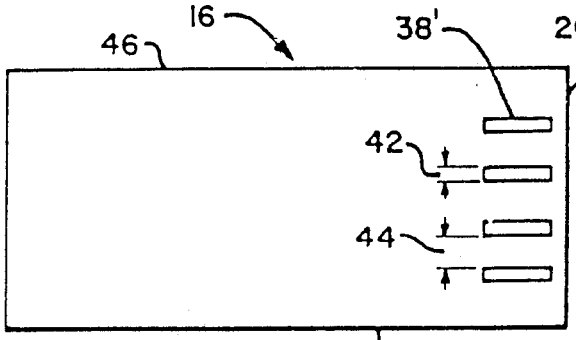
FIGS. 2(*a*) and (*b*) are elevation and plan views respectively, of one of the circuit boards illustrated in FIG. 1.
Figure 3:
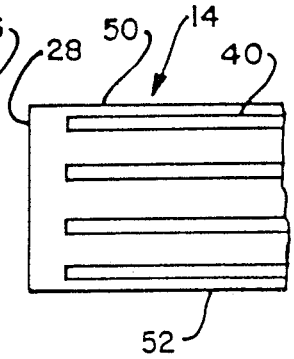
FIG. 3 is an elevation view of one ribbon cable to be connected to a circuit board of the type shown in FIG. 2.
Figure 2B:
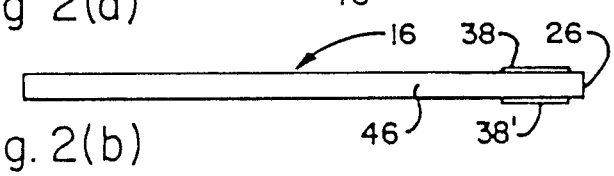

The details of how the foregoing is accomplished in the embodiment of FIG. 1, will be further described with reference to FIGS. 2–7. As shown in FIGS. 2 and 3, the circuit board 16 is generally flat and rectangular, having opposed vertical edges 26 and upper and lower edges 46 and 48, respectively. On or adjacent to the vertical edge 26, the board 16 caries a plurality of horizontally spaced apart contacts 38, 38′, leading to electrical components, devices, and other structure carried by the board. The width of the contacts 38′ shown in FIG. 2 is exaggerated for illustrative purposes. In the preferred embodiment, the contact width 42 and contact spacing 44 would be less than about 0.01 inch and could be as small as 0.002–0.005 inch. The contacts 38 are to be connected with corresponding contacts 40 carried by the ribbon cable 14 as shown in FIG. 3.

It should be appreciated that the base material of the circuit board 16 is nonconducting, and that, likewise, the web portion of the ribbon cable 14, between the conductors 40, is nonconducting. Furthermore, in the illustrated embodiment, the back side of the ribbon cable, not visible in FIG. 3, is totally nonconducting at least in the region of the connector, the cable conductors 40 having contacts exposed only on one side, i.e., the side viewed in FIG. 3. Typically, the circuit board 16 will have conductor contacts on both sides, i.e., 38′ on the side as viewed in FIG. 2(*a*) and 38 on the other side, as shown in FIG. 2(*b*). Accordingly, it can be appreciated that the conductor contacts 40 on cable 14, are to mate with the conductor contacts 38 on the back side of the circuit board 16. As shown in FIG. 1, typically a pair of cables would be connected to one circuit board 16, one cable on each side of the board, but other arrangements are possible. It should be understood that FIG. 1 illustrates a plurality of cables 14 connected to a plurality of boards 16.

The connection of a single cable 14 through the rack 12 onto one side of a single circuit board 16 will now be described. The illustrated embodiment includes a rack wall 12 that extends upwardly from the plane of the drawing of FIG. 1 as seen in elevation view in FIG. 7. For purposes of illustration, it may be assumed that the opposed walls 12 are essentially identical. Each wall 12 has a rail portion 34 onto which a portion of the connector rests. It should be understood that the details of the rack structure, and the way in which the connector 18 is supported or mounted within the rack, is illustrative only, and not intended to preclude other supporting and mounting designs that advantageously utilize the present invention.

Figure 4:
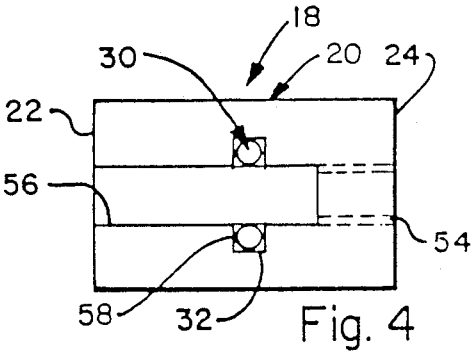
FIG. 4 is a plan view of the guide member in accordance with the preferred embodiment of the invention, that accomplishes the edge connection between the ribbon cable and the circuit board as shown in FIG. 1.
Figure 6A:
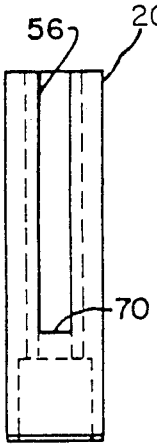
FIGS. 6(*a*), (*b*) and (*c*), are front, side, and rear elevation views, respectively, of the guide member shown in FIG. 4.
Figure 6B:
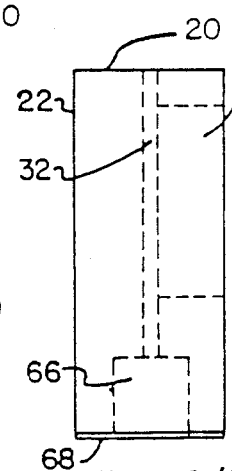
Figure 6C:
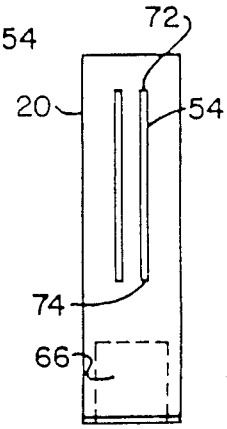

As shown in FIG. 7, the conductor member or cable 14 is first passed through slot 76 in the rack. The connector 18, as shown in FIG. 4, is then lowered into the rack such that the outer portion 24 faces the rack 12. The cable is then passed through cable slot 54 until the leading end of the cable 28 enters the board slot 56. As shown in FIG. 6(*c*), the cable slot 54 has an upper guide 72 and a lower guide 74 that precisely match the distance between the upper edge 50 and lower edge 52 of the cable. The distance travelled by the cable 14 through slots 54, 56 is sufficient to assure that the corresponding contacts 38, 40, will be properly aligned when the board 16 is inserted into the connector 18 as described below. After the pair of cables have been inserted into the connector 18, and the leading ends 28 pulled through board slot 56 toward the inner portion 22, to a position past the locking means 30, the connector 18 can be lowered further into the rack and supported on the rail 34. If desired, an adhesive or other means may be provided to secure the leading end 28 or other portion of the cable to the guide means 20. The plug 268 is mounted for displacement through the window 270 in the wall of the guide member 214. It should be understood that if the other end of the circuit board is to also have electrical connection, a similar procedure would be followed.

Once one or more of the connectors 18 is in place on the rack, a circuit board 16 can simply be lowered through board slot 56 until it comes to rest on the ledge 70. The location of the ledge 70 is chosen in relation to the slot 54 and guides 72, 74, to assure that when the cable is installed in the guide as described above, and the board is inserted into the connector to rest on the ledge 70, the conductors 38, 40 will properly be aligned. Adequate clearance, e.g., on the order of 0.002 inch, should be provided between the cable and board conductors to avoid damaging them during insertion of the board, but excessive clearance could result in inadequate engagement upon actuation of the locking means 30.

The locking means 30 are preferably located within a recess 32 extending over at least the vertical span of the conductors 38, 40, adjacent the area in the inner portion of the guide means 20 where the cable 14 and board 16 overlap. In the illustrated embodiment, the nonconducting, back side of the ribbon cable faces the locking means 30. As the locking means expands, the cable is urged toward the board, and the aligned conductor surfaces engage and are thereby locked in place.

Figure 5B:
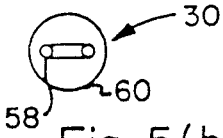
FIG 5(*a*) and (*b*) are elevation and plan views, respectively, of the fluidic membrane actuation structure associated with the guide means of FIG. 4.
Figure 5A:
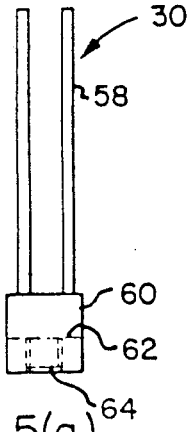

As shown in FIGS. 5 and 6, the connector preferably comprises the guide means 20, which can be made of a plastic or similar material in which the slots and passageways hereindescribed could readily be formed, and a locking means 30 which is carried by, and preferably within, the guide means. The guide means 20 in accordance with the illustrated embodiment includes recessed 32 into which compliant expandable tubes 58 are inserted. Each tube spans the contacts 38, 40, or 38', and is preferably connected to a reservoir 60. Actuation means, such as a piston 62 and screw advance 64, are provided to enable the person assembling the connector bank 10 to actuate the locking means by pressurizing the tubes so that they will expand. Other tube arrangements are possible, including a U-tube having one leg sealed and the other leg having a screw advance or other means for pressurizing the tube. The tube should behave somewhat like a bladder, to transmit pressure hydrostatically. In the illustrated embodiment, a bore 66 is provided at the bottom of the guide means 20 for receiving the reservoir 60. A cover plate 68 is also provided to keep the reservoir in place.

It should be appreciated that the successful operation of this embodiment of the invention requires that the guide means 20, particularly the portion defining the recess 32, serve as a rigid backing so that actuation of the locking means 30 to expand the tubes 58 does not excessively displace the guide means rather than the cable 14. This consideration is particularly relevant where a single, stand alone connector is to be used. In a connector bank 10 such as shown in FIG. 1, support brackets 36 (only one shown) can be tightened between the first and last set of connectors on the rack, to take up the clearances and minimize the lateral expansion of the guide means upon actuation of the locking means.

The preferred embodiment having been described, it should also be appreciated that variations of the fluid actuation mechanism can be advantageously utilized. The expansion member need not make direct contact with one of the conductor members to be connected. For example, a fluid bladder or bellows could be located under a compliant membrane surface which in turn would contact one or the other conductor member. The connector could be affixed to or carried by one or the other of the conductor members, rather than being a separate, unitary piece as described herein. Furthermore, the locking means need not be carried within the guide means, so long as it functions in the manner described hereinabove.

FIGS. 8 and 9 illustrate the invention in generic embodiments, one in which the connectors to be joined are side by side (FIG. 8) and another in which the connectors are coaxial. The structures illustrated in FIG. 9 that have the same function as corresponding structures in FIG. 8 carry the same, but primed (′), numeric identifier.

FIG. 8 shows an apparatus and method for making an electrical connection 100 between a first conductor 102 and a second conductor 104. The conductors 102 and 104 are positioned relative to each other and aligned such that the second conductor 104 is in overlapping relationship with the first conductor 102. A backing member 106 is in spaced relation from the second conductor 104 and a compliant membrane surface 108 is positioned between the backing member and the second conductor. In the illustrated embodiment, the membrane 108 is simply an outer wall portion of fluid bladder 110. The bladder can be made from a variety of materials, but thin metal or Teflon, Tigon, Capton, or other materials are suitable, so long as the membrane 108 can transmit pressure nearly hydrostatically as further described below. Typically, a backing member 112 would be in contact with the first conductor 102. Note that when the conductors are first overlapped as shown in FIG. 8(*a*), no electrical contact has yet been made, i.e., this figure illustrates a "zero insertion force" embodiment.

FIG. 8(*b*) shows the connection 100 after the actuation or locking step whereby the fluid in the bladder 110 is pressurized internally through means such as described in connection with FIG. 5. If the bladder is entirely sealed, the fluid pressure can be increased by the application of a downward force to backing 106 or an upward force to backing 112. Pressurization of the fluid causes the compliant membrane 108 to bear upon the second conductor 104, acting as a fluid spring. The surface area of contact 114 between the membrane 108 and the conductor 104 is relatively widely distributed as compared with the line or multiple point contacts typically resulting from mechanical spring contact. This relatively wide surface area contact pressure is transmitted through the second conductor 104 such that an intimate electrical contact surface 116 is formed between the first and second conductors. The fluid spring effect of the present invention, provides a greatly improved electrical contact between the conductors, as compared with prior techniques.

In FIG. 9, an analogous embodiment is shown wherein the first conductor is in the form of a pin 102', and the second conductor is in the form of a coaxial socket 104' that is not quite fully annular. A backing member in the form of a tube 106', is coaxial with and spaced from the socket 104'. A toroidal bladder 110' having its inner surface 108, act as the membrane, is coaxially spaced between the second conductor 104' and the tube 106'. As in FIG. 8(*a*), FIG. 9 shows a no-force overlap, or insertion, of the first and second conductors. To fully mate the conductors, pressurization of the torus 110' is performed such that the membrane surface 108, "shrinks" down onto the outer surface of the socket 104' until the surface 116' of the socket conductor is in intimate, conforming relationship with the pin conductor 102'.

As in the embodiment illustrated in FIG. 8, the fluid bladder 110', acting through the membrane surface 108', has the effect of a fluid spring. The advantage of this fluid spring effect can be particularly important if, for example, the conductors 102', 104' are multi-conductors, wherein a plurality of tiny contact surfaces are spaced along the outer surfaces of the pin conductor and the inner surface of the socket conductor. As the torus 110' presses against the socket, the contact surface 116' of the socket will have a tendency to conform to the contour of the pin 102'. With conventional mechanical spring or lock arrangements, the inner surface of the socket would assume a predetermined shape almost independent of the contour of the pin. The fluid spring effect of the present invention enables the inner surface 108' to more closely follow the contours of the pin 102'. This provides greater assurance that all of the plurality of contacts are mated, and that such mating is sufficiently intimate to avoid signal deterioration or contact vibration.

It should be appreciated that a variety of techniques are available to actuate, or pressurize the torus 110'. An annular wedge-like member (not shown) could be screw advanced between the backing member 106' and the torus 110' or the backing member 106' could be tapered such that the torus, when advanced linearly within the tube, would be compressed by the tapering walls of the tube.

Figure 10:
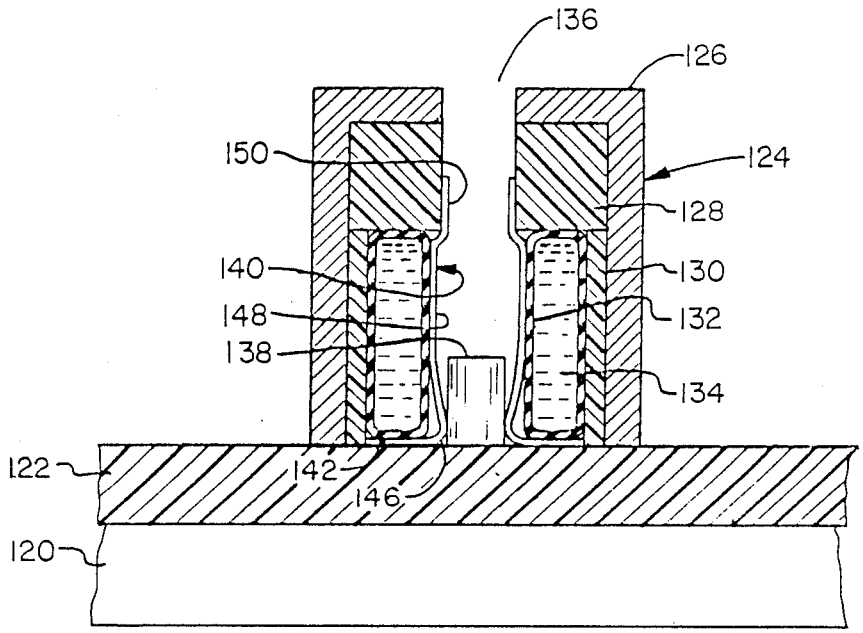
FIG. 10 is an end view, in section, of another embodiment of a connector for "mother" and "daughter" boards in accordance with the invention.
Figure 11:
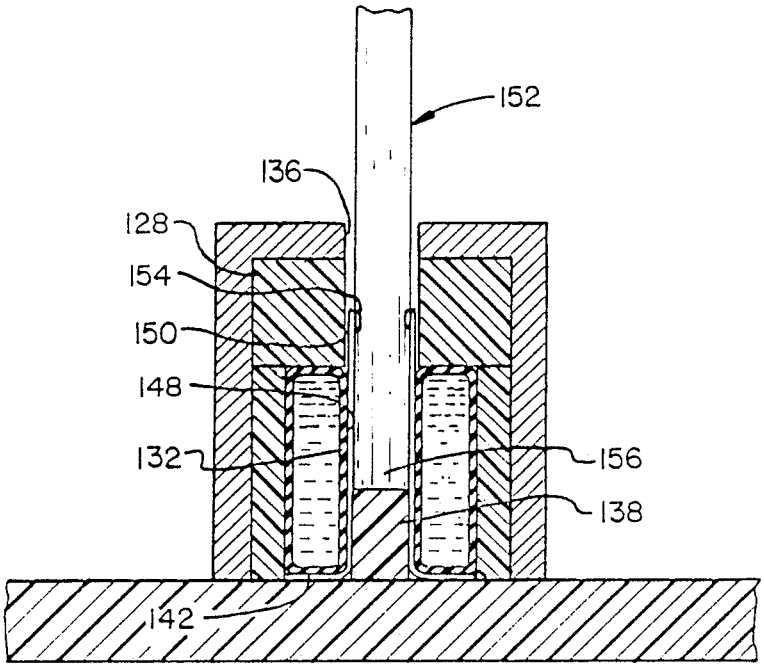
FIG. 11 is a view of the connector of FIG. 10, showing the electrical connection between the mother and daughter boards resulting from the actuation of a fluidic bladder.
Figure 12:
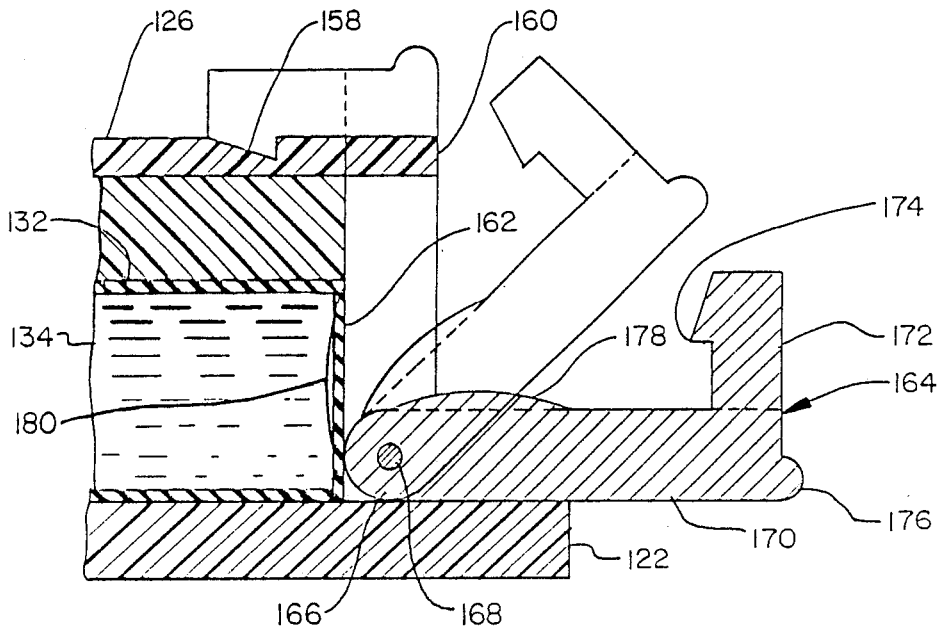
FIG. 12 is a side view of one end of the connector of FIG. 10, showing the operation of a latch lever for pressurizing the fluidic bladder.

FIGS. 10–12 show a variation of the embodiment of FIGS. 1–7. A mother board 120 includes a contact strip 122 on which one or more connectors 124 are secured. For example, one such connector would typically have a plurality of contacts for receiving a card edge having a similar plurality of contacts.

The connector 124 of FIG. 10 is symmetric about a vertical center line, and includes a stainless steel housing 126 made in the form of spaced apart, "L" shaped angular members, with the free end of the long leg of the "L" abutting the strip 122 and the free end of the short leg of the "L" facing but spaced from each other. In the inside corner between the short and long legs of the housing portion 126, are positioned nonconducting, upper spacer members 128. A substantially rigid backing strip or plate 130 extends longitudinally against the long leg of the housing 126 between the spacer 128 and strip 122. A bladder 132 containing confined fluid 134 extends in contact with the spacer 128 and backing strip 130, with the inner most walls facing each other in space apart relation. The short legs of the housing, the opposed faces of the spacers 128, and the opposed inner walls of the bladder 132, define an edge slot 136, for receiving the daughter board, or card edge as will be described below. A stop rib 138 is located between the bladders 132, in abutting relation with the strip 122, to serve as a stop and/or guide for the leading edge of the card. Preferably, each of the housing 126, spacer 128, backing 130, and bladder 132 are elongated, unitary members which are conveniently bonded together.

A plurality of contact members 140 are positioned in spaced relation (such spacing being in the perpendicular direction to the plane of FIG. 10), in order to receive a corresponding plurality of contacts on the card leading edge. Each contact member 140, preferably includes a foot portion 142 sandwiched between the lower surface of the bladder 132, and strip 122. A lower bend portion 146 contacts the stop member 138 near the lower portion thereof, and has an inverse curvature such that the central portion 148 contacts the inwardly facing surface of the bladder 132. An upper kink terminates in a contact pad 150 that rests on the inner surface of spacer 128. The foot portion 142 of each contact member 140 can be in electrical contact with a lead or other electronic path associated with strip 122 for communication with the mother board 120. When it is desired that a daughter board be electrically connected to the mother board 120, the leading end of the daughter board is inserted into the slot 156, which provides sufficient space for an interference-free fit.

As shown in FIG. 11, the daughter board or card 152 has a plurality of contacts 154 in space apart relation in a direction perpendicular to the plane of the paper, such spacing being similar to that of the contact members 140. Preferably, when the leading edge 156 of the daughter board 152 abuts the stop member 138, each of the contacts 154 is in overlapping relation with the surfaces 150 of contact members 140. This overlap may desirably include a slight interference fit. Once the board 152 is thus positioned, the fluid in the bladder 132 is pressurized so that the bladder walls expand. This expansion has two significant results. Each contact member 140 experiences forces which tend to urge the foot portion 142 toward the strip 122 and the intermediate portion 148 toward the leading edge 156. The contact member surfaces 150 are thereby urged into tighter, intimate mating with the board contacts 154. Thus, the pressurization of the bladder 132 enhances the electrical contact between the foot and the strip 122, provides a friction holding force against the leading edge 156 of the board 152, and promotes an intimate contact between pad surface 150 and contacts 154.

As shown in FIG. 12, one manner of pressurizing the bladder 132 is accomplished by providing a pivot latch 164. Preferably, the strip 122 extends beyond the end 162 of bladder 132. Similarly, the end portion 160 of housing 126 extends beyond the bladder end portion 162. A cut-out 158 is formed on the upper, "short leg" surface of the housing 126. The latch 164 is also generally L-shaped, with the free end 166 of the long leg 170 secured to a pivot axle 168 which, in turn, is in fixed relation to the housing 126. The short leg 172 has a notch 174 which, when the latch member 164 is pivoted 90 degrees from the horizontal to the vertical position, mates with cut out 158. The long leg portion 170 includes, near the pivot axle 168, a cam surface 178 which presses against the end 162 of the bladder 132 when the latch 164 is secured by engagement of the cut out and notch 158, 174. Preferably, a ridge 176 is provided for manipulating the latch with the thumb. The cam surface 178 pressurizes the fluid sufficiently to transmit a substantially hydrostatic force throughout the membrane surface of bladder 132, thereby effecting the connected arrangement shown in FIG. 11.

An evenly distributed force is transferred to all of the electrical contact surfaces, thus effecting simultaneous dry-circuit contact between the daughter and mother boards.

The connector illustrated in FIGS. 10–12 may, for example, be designed with two groups of 60 contact members 140 on each side of slot 136 for a total of 240 contact pad surfaces 150 in a total package 4 inches long. The contact pads 150 are 0.013 inch×0.025 inch in size. The desired normal force is, for example, 75 grams per contact. The desired internal pressure to achieve this contact force would thus be 508 p.s.i. (75 g./(454 g/lb.×0.013 inch×0.025 inch)). Due to the nature of hydraulics, a modest pressure on end of 162 of bladder 132 results in a force multiplication. With a bladder end surface area 162 of 0.060 inch×0.240 inch and a pressure of 508 psi, the latch lever 164 need only exert 7.32 lbs. of force on each bladder 132. In order to contain the 508 p.s.i. of pressure, the connector housing 126 is formed from 0.040 inch thick steel. The hydraulic bladder 132 consist of extruded polymer tubing with various secondary forming and sealing operations. The several spacers and cams are all molded or die-cast parts. Due to the extended service life often desired in these applications, every aspect of the design can be geared to the elimination of the necessity for glues, bonding agents, and even solder.

The arrangements shown in connection with the illustrated embodiments may be modified to be used with low insertion force (LIF) front entry card edges, PCB stacking connectors, ZIF pin and socket systems and chip on board COB sockets for directly contacting the bonding pads on solid state devices without any lead frame or packaging (also referred to as "Level Five Interconnect").

It should also be appreciated that the present invention could be used to improve wiper or other interference fit contacts. For example, in FIG. 8(*a*) the bladder 110 could be pressurized at all times such that as conductors 102 and 104 are moved into overlapping relationship, they come into contact and, as they move into their final positions, the fluid spring force produces essentially the same intimate contact as represented in FIG. 8(*b*). Alternatively, the first and second conductors may be oriented such that as they are moved into overlapping relationship, they establish a slight interference fit, and thereafter, the fluid bladder is actuated to lock them into intimate engagement.

Figure 14:
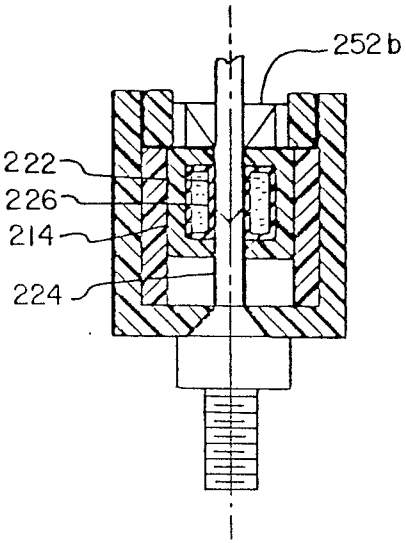
FIG. 14 is a view similar to FIG. 13 but with the chassis connector in the closed position to achieve the high pressure, compliant connection.
Figure 13:
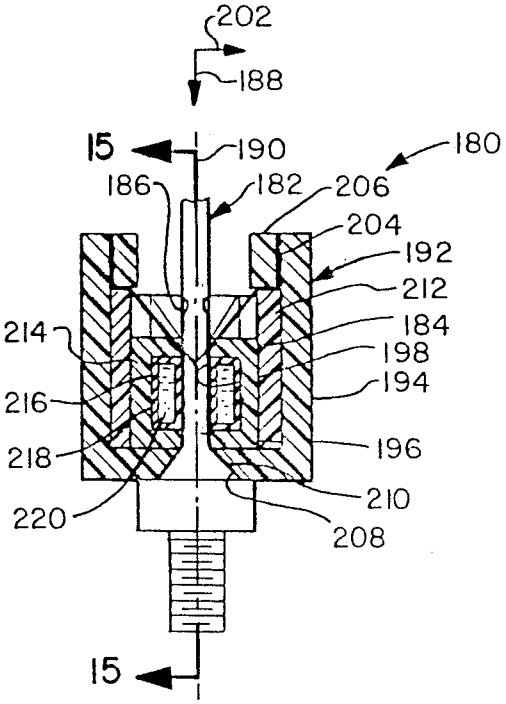
FIG. 13 is a section view of another embodiment of the invention directed to a chassis with a ZIF card edge connector, somewhat similar to the type shown in FIG. 10, including a further improvement for implementing the intimate, compliant connection between flex circuit conductors in the chassis and corresponding conductors on the card edge, showing the card edge in the initially inserted position and the chassis connector in the open position.

FIGS. 13 and 14 show another surface mount edge connection 180 for a card 182 having a leading bevelled edge 184 and a plurality of edge conductors 186. For convenient reference, the direction of insertion of the card 182 into the chassis connector 192 will be referred to as the first direction 188. The card is inserted along chassis centerline 190, into the generally U-shaped housing 194 until the edge 184 seats in a V-groove in non-conducting central rib 196. The connector 192 extends longitudinally into and out of the plane of the paper which will be referred to as the second direction 200 (see FIG. 15). The mutually perpendicular direction in the plane of the paper of FIG. 13 will be referred to as the third direction 202. It should thus be appreciated that the edge conductors 186 each extend along the first direction 188 and are spaced apart from each other along the second direction 200.

In FIG. 13, the card 182 is fully seated in the rib 196, but none of the edge conductors 186 is in contact with the respective chassis conductors 198. The chassis conductors 198 also extend generally in the first direction and are spaced apart in the second direction, but they are preferably quite flexible. The conductors 198 are secured at their upper ends 204 between a non-conducting bar 206 and housing 194 and at their lower ends 208, they are secured between tapered mating surfaces 210 at the base of the rib 196 and housing 194.

A non-conducting spacer bar 212 extends in the second direction along the vertical leg portions of housing 194 between the bar 206 and the base portion of the housing. Gland member 214 extends longitudinally in the second direction and is confined on three sides by wall means 216 defining a recess for the bladder in the gland member. The bladder 218, while retained in the gland 214, has an active exterior surface which, in the illustrated embodiment, is in direct contact with each chassis conductor 198. Alternatively, a thin, compliant membrane could be interposed between the bladder 218 and the chassis conductors 198 or the gland 214 could include a thin membrane or equivalent surface between the bladder 218 and the conductors 198. The bladders 218 are filled with an incompressible fluid 220.

In accordance with the present invention, after the card edge 184 is in place on rib 196, the gland 214 is raised in the direction opposite to arrow 188, such that the chassis flex conductors 198 are reshaped into the form shown in FIG. 14. In FIG. 14, it is evident that the flex conductors 198 are now in contact with their respective edge conductors 186 as shown at 222. The portion of the chassis conductors 198 remaining below the gland 214 may be bonded to rib 196 if desired. The verticaltravel of the gland 214 and associated bladder is made before pressurization of the bladder, so that alignment of the conductors 186 and 198 and resulting low force wiping will not damage the flex circuits 198. Thus, the first step associated with the transition from the arrangement shown in FIG. 13 to that shown in FIG. 14 is the displacement of the gland member a predetermined distance between a position in which the conductors 186, 198 are not in contact to a position in which the conductors are in substantially pressureless contact.

From this condition of substantially pressureless contact between the conductors, the fluid 220 in the bladder 218 is pressurized to sustain a high pressure, compliant, intimate contact between the conductors 186 and 198. This pressurization is preferably achieved by applying a predetermined force to an exterior portion of the bladder remote from the conductors. Due to the initial step of achieving pressureless contact, the fluid displacement required in the bladders is very small as the pressurization relies on the force multiplication of the confined fluid in the bladder.

FIGS. 15–19 illustrate the preferred structure for implementing the multi-step technique described above with respect to FIG. 13 and 14. The preferred actuating mechanism 228 includes a guide member 230 which is movable in the second direction 200 relative to the chassis base 232. The chassis 232 includes an anchor member 234 containing a pivot pin 236 which is secured to latch lever 238. The lever arm 240 is adapted to be manually rotated through the various positions shown in FIGS. 16–19. The latch lever controls a profiled cam surface 242 which, in the illustrated views, lies between the arm 240 and the guide member 230. The cam surface 242 is located so as to interact with the gland 214, which also lies between the arm 240 and the guide 230. The guide 230 has a lower ledge 244 including a notch 246 for receiving a pin 248 projecting from the latch lever 238. The pin 248 is confined within notch 246 but may "float" therein according to the rotational position of the latch lever 238 about pin 236.

Figure 15:
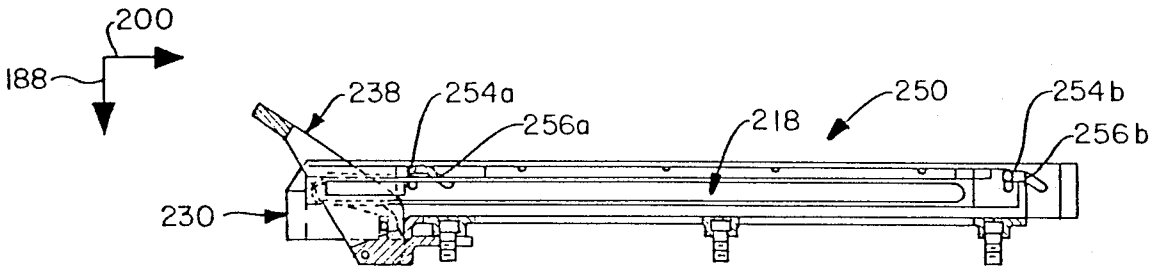
FIG. 15 is a side view of the connector of FIG. 13, sectioned on the connector centerline, but with the flex circuits and central rib on which the card abuts omitted for clarity.
Figure 17:
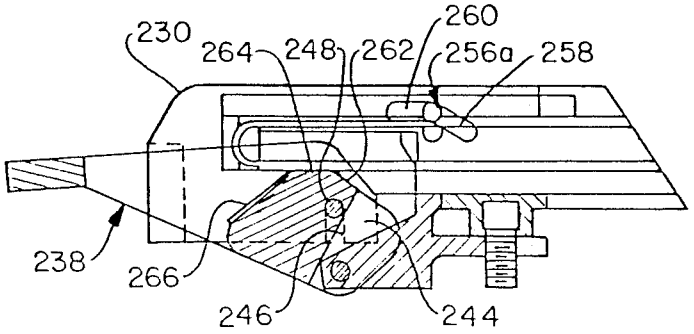
FIG. 17 is a view similar to FIG. 16, showing the connector actuating lever in a partially rotated position wherein a positioning pin on the gland which carries the bladder, has moved up in the cam slot.
Figure 16:
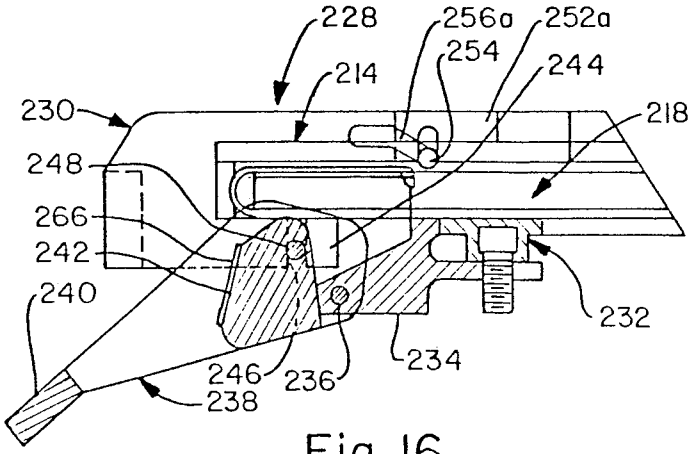
FIG. 16 is an enlarged view of a portion of the connector shown in FIG. 15, in the open position corresponding to FIG. 13.

As shown in FIG. 15, the guide member 230 extends in the second direction a distance greater than the longitudinal extend of the card in the second direction. The longitudinal extent of the card, particularly the extent of the edge conductors on the card in the second direction, is indicated as the contact area 250 in FIG. 15. The actuation mechanism described with reference to FIGS. 16–19 is located beyond the card at the left of FIG. 15. Some associated structure for supporting the movement of the guide 230 is also located beyond the active region on the right as shown in FIG. 15. The upper ledges **252*a*, 252*b* on guide member 230 include cam slots 256*a*, 256*b* respectively, each of which includes a sloped region 258 and a horizontal dwell region 260. Corresponding positioning pins 254*a*, 254*b* are carried by the gland 214**.

The following description explains how the latch lever 238 produces firstly, a displacement of the guide member 230 in the second direction and a corresponding lift in the gland member 214 opposite to the first direction 188, followed by a pressurization of the bladder. The connector open position shown in FIG. 16, corresponds to the open position of the connector shown in FIG. 13. The rotation of the latch lever 238 through approximately one quarter of its throw, to the position shown in FIG. 17, has the effect of displacing gland 230 toward the right. Simultaneously, the transfer of actuating force from the first cam surface 262 to the second cam surface 264, raises the gland 214 relative to the guide member 230. The movement of the guide 230 to the right drives the positioning pin 254 upwardly in cam slot region 258, but the profiled surfaces 262, 264 do not produce any net pressure against the gland 214.

Figure 18:
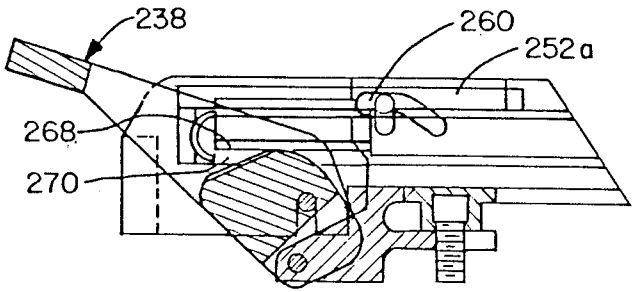
FIG. 18 is a view similar to FIG. 17 showing the lever rotated approximately three-quarters, with the positioning pin having moved to the dwell region of the cam slot whereby the gland member has been raised to the position shown in FIG. 14.

As shown in FIG. 18, a portion of the gland 214 serves as a pressure plug 268 for pressurizing the bladder 218 and such pressurization should not occur prematurely, i.e., pressurization during the lifting of the gland is to be avoided. Such pressurization is desired in the transition between FIGS. 18 and 19 where the third profiled surface 266 which preferably carries or is formed as a spring surface 266, penetrates a window or the like 270 in the wall of the gland 214 so as to bear against an exterior surface of the pressure plug 268 or bladder remote from the conductor contacts. This occurs while the positioning pin 254 is in the dwell region 260 of the cam slot, so that although the guide member 230 continues to move in the second direction, the gland is stationary while the bladder is being pressurized.

Figure 19:
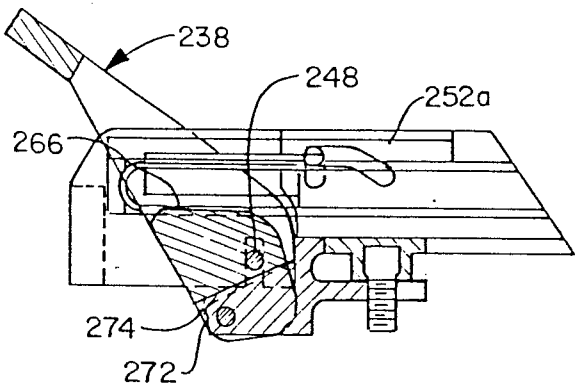
FIG. 19 is a view similar to FIG. 17 showing the lever rotated to its fully latched position whereby pressure plugs have been driven against a portion of the bladder through windows in the gland, thereby squeezing the bladders to create a high pressure intimate contact between the chassis and card conductors.

FIG. 19 corresponds to the condition shown in FIG. 14 with the latch lever fully rotated and the spring surface 266 bearing against an exterior portion of the bladder. It may be appreciated that due to the particular linkage among the anchor 234 and its associated nose portion 272, the latch lever 238 and associated thrust surface 274 bearing on nose portion 272, and the pivoting effects of pins 236 and 248, the arrangement operates somewhat like a toggle or overcenter latch so that once rotated to the position shown in FIG. 19, the latch lever remains therein so as to maintain the pressure on the bladder. A positive resistance must be overcome to return the latch lever 238 to the other positions shown in FIGS. 16–18.

It should be appreciated that in the embodiment of the invention shown and described with respect to FIGS. 13–19, the connector is adapted to receive a card having edge conductors 186 on both sides of the card. Accordingly, the respective chassis conductors 198, glands 214 and associated bladders 218 are provided in pairs, but this arrangement could readily be modified, if desired, to accommodate a card having conductors 186 on only one side.

In one implementation of the card edge connector embodiment shown in FIGS. 13–19, actuation with the latch lever requires about 2.5 lbs. of user force to mate 240 contacts. The hydraulic pressure created is 508 lbs./sq. in., yielding a normal force of 80 grams/contact. It also produces a light pressure wiping action during the transition between FIGS. 16 and 17, to help remove any contaminants which may be present. Bladders made of polymer tubing filled with hydraulic fluids can be pressurized and depressurized to more than 1,000 psi for well over 20,000 cycles with no discernible degradation of the parts. The fluid displacement is very small, slightly under 0.002 cu. in. in the bladder. The cams as supplemented by the constant force bearing spring surface, generate 7.4 lbs. per bladder, with the 15 lbs. total resulting from the mechanical advantage of the lever. In this preferred embodiment, the light wiping at zero insertion force, with the use of the flex circuit conductors on the connector, permit absolute impedance matching. The flex circuit conductors are protected in that gross relative motion between the card edge and the chassis conductors is accomplished without excessive friction or interference between the conductors. After this substantially pressureless contact, high pressure actuation is accomplished without movement or significant expansion of the bladder, i.e., the high pressure is achieved in a hydrostatic manner, and not by dynamic movement. The expansion of the bladder is infinitesimal, because the bladder is fully confined prior to the application of the pressurizing force, whereupon it transmits the high pressure hydrostatically to the conductors. Such expansion would be incidental and result from the filling of minuscule corners and the like in the walls which confine the bladder. Thus, the second step of the actuation procedure in accordance with the preferred embodiment, is, in essence, static, rather than dynamic, with respect to the gland and bladder.

Finally, the force balanced actuation, such as by the use of a spring between the bladder and the cam surface on the latch lever, further assures that a predetermined sufficient but not excessive pressure increase will be supplied to the bladder. The constant, or balanced force embodiment of the invention is superior to a pure displacement actuation system, in that the constant force allows the connector to function over a wide temperature range and to accommodate tolerances and other changes during the life of the connector.

A further advantage of the present invention is that different contact pitches in the same connector body need only involve the production of different flex circuits. Mixing power and signal contacts, impedance matching of the contacts with the system requirements, and various other "custom" design considerations, can all be accommodated by the same technique.

Figure 20:
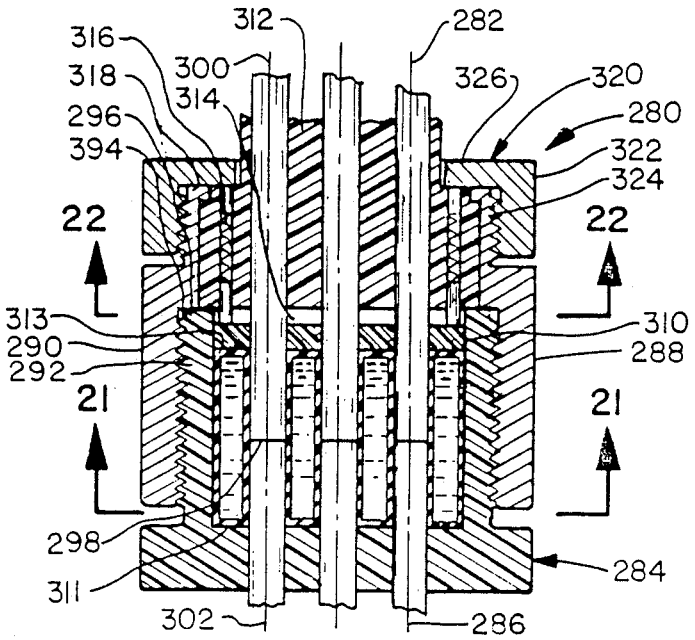
FIG. 20 is a section view of a socket and plug embodiment of the invention, including a bladder annularly spaced around the junctures of a respective plurality of plug and socket conductors.
Figure 21:
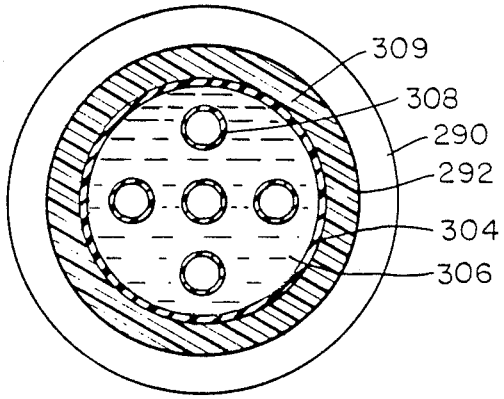
FIG. 21 is a section view along line 21—21 of FIG. 20.
Figure 22:
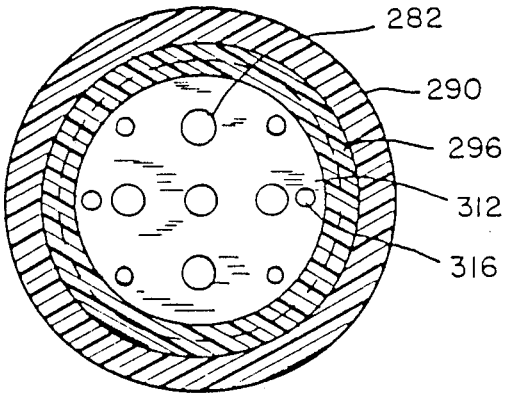
FIG. 22 is a section view along line 22—22 of FIG. 20.

FIGS. 20–22 illustrate yet another embodiment of the invention, having the principal purpose of improving the socket and plug type connection of signal conductors, particularly light pipes for optical signal transmission.

In this embodiment, the socket connection 280 is formed by a plug member 288 carrying a plurality of plug conductors 282, and a socket member 284 carrying a respective plurality of socket conductors 286. These conductors abut end to end as shown in FIG. 20, or they could be in overlapping or telescopic contact. The plug includes an interiorly threaded collar 290 which overlaps and engages an exteriorly threaded neck 292 on the socket. The terminal end 294 of the neck 292 abuts an internal shoulder 296 on the plug collar 290 for defining the initial mating or registry of the plug conductors 284 and the socket conductors 288. In the light pipe embodiment, this results in an abutting mating contact 298.

Theoretically, the mating contact at 298 results in the plug conductor axes 300 aligning precisely with the socket conductor axes 302, but this does not necessarily occur. With electrical conductors, such alignment would not be critical, but with light pipe connections, discontinuities or irregularities of any type are to be avoided at the transition of the plug to socket conductor junctions. Conventionally, the relationships of the conductors to the plugs and sockets can be fabricated with sufficient control to assure that the conductors are supported axially within their respective plug or socket, and that upon closures of the plug and socket, the ends abut as at 298. Such connection does not, however, always assure coaxial alignment of the axes 300, 302.

In accordance with the present invention, a bladder member 304 is carried in the socket so as to surround each of the conductor junctions 298, whereby pressurization of the incompressible fluid 306 within the bladder produces a uniform, radially inwardly directed, compliant pressure on the junction 298, thereby promoting alignment of the axes 300, 302. In addition, this further stabilizies the mating ends of the conductors against vibration and other disturbances. The bladder thus defines an annular wall 308 surrounding the junction 298 of each conductor.

In the illustrated embodiment, a single bladder having an outer wall 309 contains a plurality of internally formed, annular membrane walls 308 which respectively surround the junctions 298 of the conductors 282, 286. The fluid 306, when pressurized, acts with a uniform pressure on the membranes 308. The bladder 304 has a rear wall 311 and a front wall 313, through which the conductors pass. The bladder is fully confined by the interior wall of the socket neck 292 and the back wall of the socket, except that the front wall of the bladder is confined by a movable pressure plate 310 in the socket. The pressure plate has apertures through which plug conductors 282 pass when the plug is advanced into the socket. When the end 294 of socket neck 292 abuts shoulder 296 on plug collar 290, a space 314 remains between the insulating fill 312 in the plug surrounding the plug conductors 282, and the pressure plate 310.

A plurality of pin holes 316 are provided in the insulating material 312 parallel to the conductors 282 for respectively receiving a plurality of spring loaded pressure pins 318 carried by the plug. The front of each pressure pin 318 bears on pressure plate 310 whereas the rear of each pressure pin projects from the insulating material 312. A pressure sleeve 320 includes a threaded portion 322 which is advanced along a threaded extension 324 of the plug collar and independently of the threaded connection between the plug collar 290 and the socket neck 292. The pressure sleeve includes a thrust surface 326 which contacts the exposed ends of the pressures pins 318 and urges them against the pressure plate 310, thereby pressurizing the bladder 304. This pressurization acts at the junctions 298 to provide a uniform pressure therearound, which promotes true axial alignment of the conductor axes 300 and 302.

It should be appreciated that the particular form of the bladder and the manner of actuating the bladder may vary from that illustrated in the accompanying figures without departing from the scope of the invention. As with the previously described embodiment, the pressurization of the bladder is accomplished with a force balanced actuation, i.e., the force applied by the pressure plate 310 to an exterior surface of the bladder is nearly independent of the displacement of pressure sleeve 230, but rather depends primarily on the constant force transmission character of the springs bearing on pin 318. In this context, "nearly or substantially independent" means that the spring rate can be selected such that a range of spring displacement provides an acceptable range of pressurization of the bladder.

It is within the scope of the invention to provide a separate compliant membrane and fluidic actuator, where that might be advantageous. It should be further understood, however, that an important advantage of the invention relates to the compliant transmission of the fluid pressure through the membrane, approaching ideally the application of the hydrostatic pressure of the fluid to the second conductor. In many applications of the present invention, the pressure desired at the mating surfaces between the contacts of the first and second conductors, is in the range of about 400–1600 p.s.i. The fluid pressure within the bladder required to generate this specific pressure at the contact points, is typically large enough to product compliant behavior in membranes from the materials listed above and their equivalents.

I claim:

1. An electrical connection between two multi-conductors, comprising:

a first multi-conductor having a first side including a plurality of first electrical contacts, and a substantially rigidly supported other side;

a second multi-conductor having a plurality of second electrical contacts overlapping the first contacts;

rigid backing means defining a recess spaced from and spanning all the second contacts;

bladder means filled with a substantially constant volume of incompressible fluid, the bladder means filling the recess and being confined between the backing means and the second multi-conductor; and a latch lever secured in a predetermined locked position relative to the backing means and having a cam surface acting on the exterior surface of the confined bladder means for urging a portion of the bladder means against the second multi-conductor whereby an intimate electrical connection is established between all the first and second contacts.

2. The electrical connection of claim 1, wherein said cam surface is spring loaded against the bladder when the latch is in the locked position.

3. An electrical connector comprising:

a housing including two, rigid, spaced apart housing shells having opposed inner ends defining a slot;

a bladder member filled with a substantially constant volume of incompressible fluid located within each shell;

a plurality of contact members arranged on both sides of the slot and in contact with a bladder;

rigid gland means cooperating with the shell for confining a respective bladder member within each respective shell; and latch means securable in a predetermined locked position relative to the housing and having a cam surface for selectively transmitting and maintaining a connector locking force against an external portion of a bladder member for pressurizing the fluid in the bladder member so that at least a portion of the bladder urges the contact members into the slot when the latch means is in the locked position.

4. The electrical connector of claim 3 wherein each bladder member is elongated and of generally rectangular cross-section defining upper, lower, outer and inner surfaces, the inner surfaces facing said slot and being adjacent to said contacts, the upper and outer surfaces being confined by said gland means.

5. The electrical connector of claim 4, wherein each of said contact members is elongated and has a foot portion abutting the bladder lower surface, an intermediate portion abutting the bladder inner surface, and a pad portion located in said slot.

6. The electrical connector of claim 5 wherein said means for confining include a backing plate between the bladder outer surface and the shell, and a spacer member abutting the shell, the backing plate, and the upper surface of the bladder.

7. The electrical connector of claim 6, wherein said pad portion extends above the bladder upper surface adjacent said spacer member.

8. The electrical connector of claim 4, further including a stop member positioned in said slot adjacent the lower surface of the bladder, for defining a stop limit of an edge of a circuit board to be inserted in said slot.

9. The electrical connector of claim 3, wherein said cam surface is spring loaded against the bladder when the latch is in the locked position.

10. An electrical connection between two conductors comprising:

a first conductor in the form of a pin;

a second conductor in the form of a cylindrical segment substantially coaxial with and partially circumferentially surrounding the pin;

a tubular backing member coaxially spaced from and surrounding the second conductor;

a fluid filled, torroidal membrane coaxial with the pin and interposed between and in contact with the second conductor and the backing member; and means for pressurizing the membrane to radially compress the second conductor, thereby establishing a compliant, intimate electrical contact between the first and second conductors.

11. An electrical connector for two conductors, the first conductor carried by a first member in the connector and the second conductor carried by a second member to be inserted in the connector, comprising:

stop means for receiving the second member in a predetermined position within the connector so that the first conductor is spaced from the second conductor;

means for relatively positioning the second conductor in substantially pressureless contact with the first conductor;

a rigid gland supported behind the first conductor and including wall means defining a recess spaced from the first conductor;

a bladder located in the recess, the bladder being confined by the wall means except for an active exterior surface in contact with said first conductor, the bladder member being filled with a substantially constant volume of incompressible fluid at a first pressure; and means for applying a predetermined pressure increase to the bladder, whereby said exterior surface transmits the increase in pressure to the first conductor such that the first conductor is urged against the second conductor at the location of said substantially pressureless contact to form an intimate, compliant connector.

12. The electrical connector of claim 11, wherein said means for applying pressure include a plug member displaceable between predetermined open and closed positions through said wall means against an exterior portion of the bladder remote from the active surface.

13. The electrical connector of claim 12, wherein said means for applying pressure includes a spring associated with the plug member and means for urging the spring against the plug member so that the total force applied by the plug member against the active surface is determined by the spring.

14. The electrical connector of claim 11 wherein the first conductor is a flexible wire segment secured at both free ends to the first member in the connector and the second conductor is a contact adjacent the edge of a card defining said second member.

15. An electrical connector for two conductors, the first conductor carried by a first member in the connector and the second conductor carried by a second member to be inserted in the connector, comprising:

stop means for receiving the second member in a predetermined position within the connector so that the first conductor is spaced from the second conductor;

means for relatively positioning the second conductor in substantially pressureless contact with the first conductor;

a rigid gland supported behind the first member and including wall means defining a recess spaced from the first member;

a bladder located in the recess, the bladder being confined by the wall means except for an active exterior surface in contact with said first member, the bladder member being filled with a substantially constant volume of incompressible fluid at a first pressure;

means for applying a predetermined pressure increase to the bladder, whereby said exterior surface transmits the increase in pressure to the first member and first conductor such that the first conductor is urged against the second conductor at the location of said substantially pressureless contact to form an intimate, compliant connection.

16. The electrical connector of claim 15, wherein said means for applying pressure include a plug member displaceable between predetermined open and closed positions through said walls means against an exterior portion of the bladder remote from the active surface.

17. The electrical connector of claim 16, wherein said means for applying pressure includes a spring associated with the plug member and means for urging the spring against the plug member so that the total force applied by the plug member against the active surface is determined by the spring.

18. The electrical connector of claim 15 wherein the first conductor is a flexible wire segment secured at both free ends to the first member in the connector and the second conductor is a contact adjacent the edge of a card member.

19. A method for joining two signal conductors comprising:

supporting a first conductor against a first backing member;

supporting a second conductor in low pressure contact with the first conductor;

positioning a compliant membrane against the second conductor;

displacing a latch member from an open to a predetermined closed position, the latch member in the closed position having a spring loaded cam surface applying a predetermined pressure increase to the membrane whereby the pressure is transmitted through the membrane to the second conductor and against the first conductor to sustain a high pressure compliant connection therebetween.

20. An electrical connector for two conductors, the first conductor carried by a first member in the connector and the second conductor carried by a second member to be inserted in the connector, comprising:

means for relatively positioning the second member in front of the first member so that the second conductor is in substantially pressureless contact with the first conductor;

a rigid gland supported in fixed position behind the first conductor and including wall means defining a recess spaced from the first conductor;

a bladder located in the recess, the bladder being confined by the wall means except for an active exterior surface in contact with said first conductor, the bladder member being filled with a substantially incompressible fluid at a first pressure; and means for applying a predetermined pressure increase to the bladder, whereby said exterior surface transmits the increase in pressure to the first conductor such that the first conductor is urged against the second conductor to form an intimate, compliant connection, wherein said means for applying pressure includes spring means operable through said wall means against an exterior portion of the bladder remote from the active surface, so that the total of said pressure increased is determined by the spring means.

21. An electrical connector for two conductors, the first conductor carried by a first member in the connector and the second conductor carried by a second member to be inserted in the connector, comprising:

means for relatively positioning the second member in front of the first member so that the second conductor is in substantially pressureless contact with the first conductor;

a rigid gland supported in fixed position behind the first member and including wall means defining a recess spaced from the first member;

a bladder located in the recess, the bladder being confined by the wall means except for an active exterior surface in contact with said first member, the bladder member being filled with a substantially incompressible fluid at a first pressure;

means for applying a predetermined pressure increase to the bladder, whereby said exterior surface transmits the increase in pressure to the first member and first conductor such that the first conductor is urged against the second conductor to form an intimate, compliant connection, wherein said means for applying pressure includes spring means operable through said wall means against an exterior portion of the bladder remote from the active surface, so that the total of said pressure increase is determined by the spring means.

* * * * *